US006854852B1

(12) United States Patent
Zadro

(10) Patent No.: US 6,854,852 B1
(45) Date of Patent: Feb. 15, 2005

(54) DUAL MAGNIFICATION REVERSIBLE SPOT MIRROR RELEASABLY ATTACHABLE TO FLAT SURFACES

(76) Inventor: Zlatko Zadro, 5422 Argosy Dr., Huntington Beach, CA (US) 92649

( * ) Notice: Subject to any disclaimer, the term of this patent is extended or adjusted under 35 U.S.C. 154(b) by 19 days.

(21) Appl. No.: 10/698,619

(22) Filed: Oct. 31, 2003

(51) Int. Cl.[7] ..... G02B 5/08; G02B 7/182; B60R 1/02; A47G 1/16; A45D 42/14

(52) U.S. Cl. ..... 359/840; 359/872; 248/467; 132/316

(58) Field of Search ..... 359/840, 850, 359/872, 879, 880, 882; 248/467; 132/296, 301, 304, 316

(56) References Cited

U.S. PATENT DOCUMENTS 1,503,378 A * 7/1924 Reid
1,788,209 A * 1/1931 Sheehan
2,071,243 A * 2/1937 Tripp
2,559,290 A * 7/1951 Engelmann
2,915,944 A * 12/1959 Butts
3,751,140 A * 8/1973 Berlin et al.
3,824,001 A * 7/1974 Rosenberg
4,486,075 A * 12/1984 Cohen
5,900,996 A * 5/1999 Zadro
6,099,133 A * 8/2000 Wright
6,305,809 B1 * 10/2001 Zadro
6,382,803 B1 * 5/2002 Arumugasaamy
2004/0047052 A1 * 3/2004 Zadro

* cited by examiner

*Primary Examiner*—Ricky D. Shafer
(74) *Attorney, Agent, or Firm*—William L. Chapin

(57) ABSTRACT

A dual magnification reversible spot mirror device includes two mirrors having different magnifications, e.g., 5X and 10X, mounted back-to-back in a cylindrical frame ring which has an outer cylindrical wall surface from which protrudes a circumferential annular ring-shaped rib, and a mirror frame holder which has protruding forwardly from a base thereof a plurality of circumferentially spaced apart, longitudinally disposed flange walls which are elastically deformable in a radially outwardly direction from a longitudinal center line perpendicular to the base. Retainer lips protruding radially inwardly from inner longitudinal wall surfaces of the flange walls are forced radially outwardly in response to rearward forcible contact with the lips by the frame rib, whereupon the flange walls deflect elastically inwardly to an undeformed position in which the mirror frame ring with a reversible selected mirror facing outwards is captivated between a front wall surface of the base and rear surfaces of the flange wall lips. The base of the mirror frame holder is pivotably mounted to a mounting base which has suction cups protruding rearwardly therefrom for releasable attachment to a flat surface such as the vertical surface of a larger wall or cabinet mirror, or the horizontal surface of a table top or vanity.

14 Claims, 6 Drawing Sheets

21
22
31F
23
25
37F
29
30F
33F
32
27
36
35
38
28
33R
30R
37R
34
26
24
31R
59R
65R
20
69
40
70
86
87
90
88
A
B

DUAL MAGNIFICATION REVERSIBLE SPOT MIRROR RELEASABLY ATTACHABLE TO FLAT SURFACES

BACKGROUND OF THE INVENTION

A. Field of the Invention

The present invention relates to mirrors of the type used by people to facilitate performance of personal care functions such as shaving, applying cosmetics, and the like. More particularly, the invention relates to a novel mirror device which includes a mirror frame assembly in which is mounted a pair of back-to-back mirror plates of different relative magnification, a mirror frame support assembly into which the mirror frame assembly is reversibly installable with a mirror plate of selected magnification facing outwardly, and a mounting base which is releasably attachable to a flat surface such as that of a large flat mirror or table top, with the mirror positioned at an adjustable inclination angle relative to the mounting surface.

B. Description of Background Art

Some aspects of a person's appearance are best attended to by observing his or her image in a relatively large "wide angle" mirror, which has unity or "1×" magnification, such as a full length wall mirror, a dresser mirror, or a bathroom mirror mounted on a wall or cabinet. On the other hand, certain personal grooming functions such as shaving, applying cosmetics and the like are generally more easily performed while viewing a larger image of one's face, which can be provided by positioning the face closer to a flat mirror of. In some circumstances, however, it is not convenient to position one's face sufficiently close to an existing flat mirror to provide an image of the face which is sufficiently large to enable a desired personal grooming task to be easily performed. In such situations, it would be desirable to have available a mirror having a magnification factor greater than one. Since available counter space in locations such as bathrooms is often at a premium, it would also be desirable to have available a magnifying mirror which is releasably and conveniently attachable to a vertical surface, such as that of an existing wall or cabinet-mounted mirror. Additionally, since different mirror magnifications are useful for performing different aspects of a person's grooming, it would be desirable to have a mirror releasably attachable to a flat surface, which had a range of different, selectable magnifications. A wide variety of magnifying and non-magnifying mirrors are available for use in people's homes. However, since a person's vision generally degrades with age, there is an accompanying need for a small, "spot" mirror of selectable magnification which can be attached to an existing larger mirror to enable a person to see image details required to perform personal care functions. Accordingly, it would be desirable to provide an inexpensive dual magnification spot mirror which is readily attachable to existing household mirrors, thus enhancing the utility and value of a person's investment in such mirrors. The present inventor is unaware of any existing mirror device which possesses the foregoing characteristics, and that unavailability was a factor motivating the present invention.

OBJECTS OF THE INVENTION

An object of the present invention is to provide a mirror device which has two selectable magnifications and which is releasably attachable to flat surfaces.

Another object of the invention is to provide a mirror device which includes a mirror frame assembly, in which are mounted back-to-back a pair of mirror plates having different relative magnifications, a mirror frame support or holder assembly into which the mirror frame is releasably insertable and retainable therewithin with a selected one of the two mirror plates facing outward of the mirror frame support assembly, a mounting base which supports the mirror frame holder assembly at an adjustable inclination relative to the mounting base, and fastening members attached to the mounting base for releasably fastening it to a flat surface, such as the vertical surface of a larger mirror.

Another object of the invention is to provide a dual magnification mirror device which includes a mounting base that is provided with fasteners for releasably fastening the mounting base to a flat mounting surface, a mirror frame holder assembly which is pivotably mounted to the base, and a mirror frame assembly in which is mounted a back-to-back pair of mirrors of different relative magnification, the mirror frame assembly being retained within the mirror frame holder assembly and removable therefrom to enable the mirror frame assembly to be reversed and reinserted into the mirror frame holder assembly, thereby enabling reversibly selectable orientation of the two mirror plates outwardly of the flat mounting surface to provide a selectable image magnification.

Various other objects and advantages of the present invention, and its most novel features, will become apparent to those skilled in the art by perusing the accompanying specification, drawings and claims.

It is to be understood that although the invention disclosed herein is fully capable of achieving the objects and providing the advantages described, the characteristics of the invention described herein are merely illustrative of the preferred embodiments. Accordingly, I do not intend that the scope of my exclusive rights and privileges in the invention be limited to details of the embodiments described. I do intend that equivalents, adaptations and modifications of the invention reasonably inferrable from the description contained herein be included within the scope of the invention as defined by the appended claims.

SUMMARY OF THE INVENTION

Briefly stated, the present invention comprehends a dual magnification mirror device which includes a reversible mirror frame that holds two circular mirror plates in a back-to-back configuration. The two mirror plates have spherically concave front surfaces of different curvatures which produce reflected images of different magnifications, e.g., 5× and 10×.

A dual magnification reversible mirror device according to the present invention also includes a mirror frame holder which has a front receptacle portion for receiving and holding the mirror frame in a fixed but reversible position within the frame holder. In a preferred embodiment, the mirror frame has a circular plan view shape; the mirror frame holder has a flat rear base wall which has a has four radially outwardly disposed legs which form a cross-like, or cruciform plan view shape. The outer transverse end of the bottom of a longer vertical portion of the base wall corresponding to the upright of the cross, and the outer transverse ends of cross bar portions of the base wall which angle laterally away from the upright, have curved transverse edges. The three curved transverse edges lie on a circle of approximately the same diameter as that of the mirror frame.

Each of the three aforementioned transverse ends of the mirror frame holder base legs has protruding perpendicularly forwards therefrom a thin, generally uniform thickness flange wall which has a plan-view curvature which conforms to that portion of the flat base of the frame holder from which the flange wall depends. Each of the three flange walls has an arcuately curved lip which protrudes radially inwardly from the front or outer edge of each of the three annular flange walls, which are made of a rigid yet flexible material, such as a synthetic polymer. The three curved lips which protrude radially inwardly from inner surfaces of the three flange walls lie on a circle which is of approximately the same diameter as that of the mirror frame, and form with the base of the mirror frame holder a generally cylindrical shaped or cup shaped receptacle or pocket, which is "skeletonized" by the absence of a cylindrical wall surfaces in the areas between adjacent legs of the base.

The mirror frame which holds the two mirror plates in a back-to-back configuration has an outer cylindrical wall surface from which protrudes a longitudinally centrally located, annular ring-shaped rib of slightly larger diameter than the inner diameter of a circularly-shaped opening formed between the diametrically opposed inner wall surfaces of the frame holder flange lips. With this construction, the mirror frame is insertable into the opening formed in the front of the mirror holder base, the annular rib protruding from the mirror frame contacting the radiused inner surfaces of the mirror frame holder flange lips and thereby deforming the flange walls radially outwardly sufficiently far to enable the frame rib to advance rearwardly of the flange lips, whereupon the flange walls deflect elastically inwards to their undeformed positions, thereby captivating the frame within the holder. Thus constructed, the frame is readily removable from the holder, reversed to position the other selected mirror plate in an outer facing, use position, and reinserted into locking engagement within the holder.

The dual magnification reversible mirror device according to the present invention also includes a mounting base which enables the mirror frame holder to be releasably yet securely fastened to a smooth, flat mounting surface such as the vertical surface of a larger flat mirror, e.g., a wall mounted or cabinet mirror, as well as a smooth horizontal surface such as that of a vanity or table top. In a preferred embodiment of a dual magnification reversible mirror device according to the present invention, the mounting base includes a mounting bracket plate which pivotably supports the mirror frame holder base.

The mounting bracket plate according to the present invention includes a plurality, preferably three, of suction cups which protrude rearwardly from the bracket. To facilitate removal of the mirror holder mounting bracket from a vertical mounting surface, the suction cups are preferably removably attachable to the bracket plate. This construction enables the bracket plate to be detached from the suction cups, which are then more readily released individually from sealing engagement with a mounting surface by peeling an edge of each suction cup away from the mounting surface.

In a preferred embodiment, each suction cup has protruding upwardly from the inverted cup-shaped base thereof, a neck or stem terminated at an upper, outer end thereof by a disk-shaped head of larger diameter than the stem but smaller diameter than the base. Also, the mounting bracket has through its thickness dimension three keyholes spaced angularly apart from one another. Each keyhole has a generally circularly-shaped portion of a diameter sufficiently large to insertably receive the head of a suction cup, and, extending laterally from the circular portion, an oval-shaped slot of smaller width than the suction cup head, but of sufficient width to enable the neck of the suction cup to slide laterally in the slot, thus securing the larger diameter head behind the outer end of the slot. This construction enables the suction cups to be attached to the mounting bracket backing plate, whereupon the rear surfaces of the suction cups are placed against a flat mounting surface, and the bracket plate pressed down towards the mounting surface to hermetically adhere the suction cups to the surface.

To remove the mounting bracket, the mirror frame holder is moved parallel to a mounting surface to thereby position a suction cup head beneath the larger diameter, circular portion of a keyhole, and the bracket plate pulled forwards away from the mounting surface, the larger diameter circular portions of the keyholes enabling the suction cup heads to be pulled through the keyholes. The suction cups are then individually removed from hermetic contact with the mounting surface. Optionally, each suction cup is provided with a small lifting tab which protrudes radially outwards from a lower peripheral edge of the surface-contacting edge wall of the suction cup. Grasping this tab and pulling it away from a surface to which the suction cup is hermetically adhered breaks the hermetic seal between the surface and the suction cup, enabling the suction cup to be easily detached from a mounting surface.

In the preferred embodiment of a dual magnification reversible mirror device according to the present invention, the mounting bracket plate is vertically elongated, and is provided at an upper end thereof with a pair of laterally spaced apart, horizontally outwardly protruding pivot pins which fit within a pair of opposed, laterally disposed and aligned tubular bushings that protrude rearwardly from the rear of the circular mirror frame holder base, near an upper peripheral edge of the vertical, upright portion of the cross-shaped back wall of the frame holder. With this construction, the mirror frame is pivotably adjustable from an orientation parallel to the vertical surface of a larger mirror or other such mounting surface, to a desired upwardly angled inclination. Thus, the dual magnification reversible mirror device according to the present invention provides a smaller, "spot" image of selectably greater magnification than a larger flat mirror to which the device is releasably mounted. Preferably, the frame holder base has through its thickness dimension a plurality of clearance holes which are aligned with the mounting bracket suction cups. The clearance holes are provided to receive the heads of the suction cups, thus enabling the mirror frame holder to be pivoted into a flush, overlying relationship with the mounting bracket plate.

DESCRIPTION OF THE PREFERRED EMBODIMENTS

Figure 2:
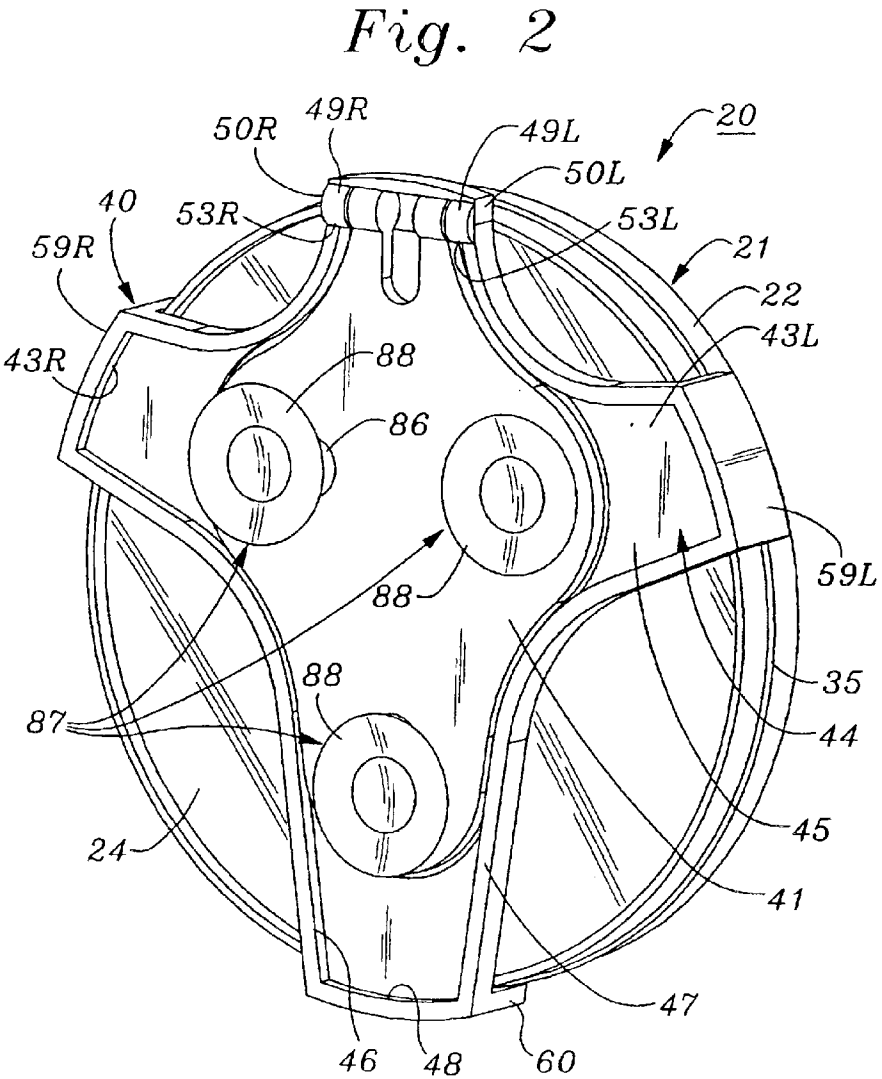
FIG. 2 is a rear perspective view of the mirror of FIG. 1.

FIGS. 1–10 illustrate various structural and functional aspects of a dual magnification, reversible spot mirror according to the present invention.

As shown in FIGS. 1–3B, a dual magnification reversible mirror 20 according to the present invention includes a dual mirror frame assembly 21 that contains within a circular ring-shaped frame hoop 22 a pair of circular mirror plates 23, 24. As may be seen best by referring to FIG. 9 in addition to FIGS. 1–3B, mirror plates 23, 24 have concave, spherically curved reflective surfaces 25, 26 of different curvature. Thus, mirror plates 23, 24 have different magnifications, e.g., 5× and 10×.

Figures 8, 9, 10:
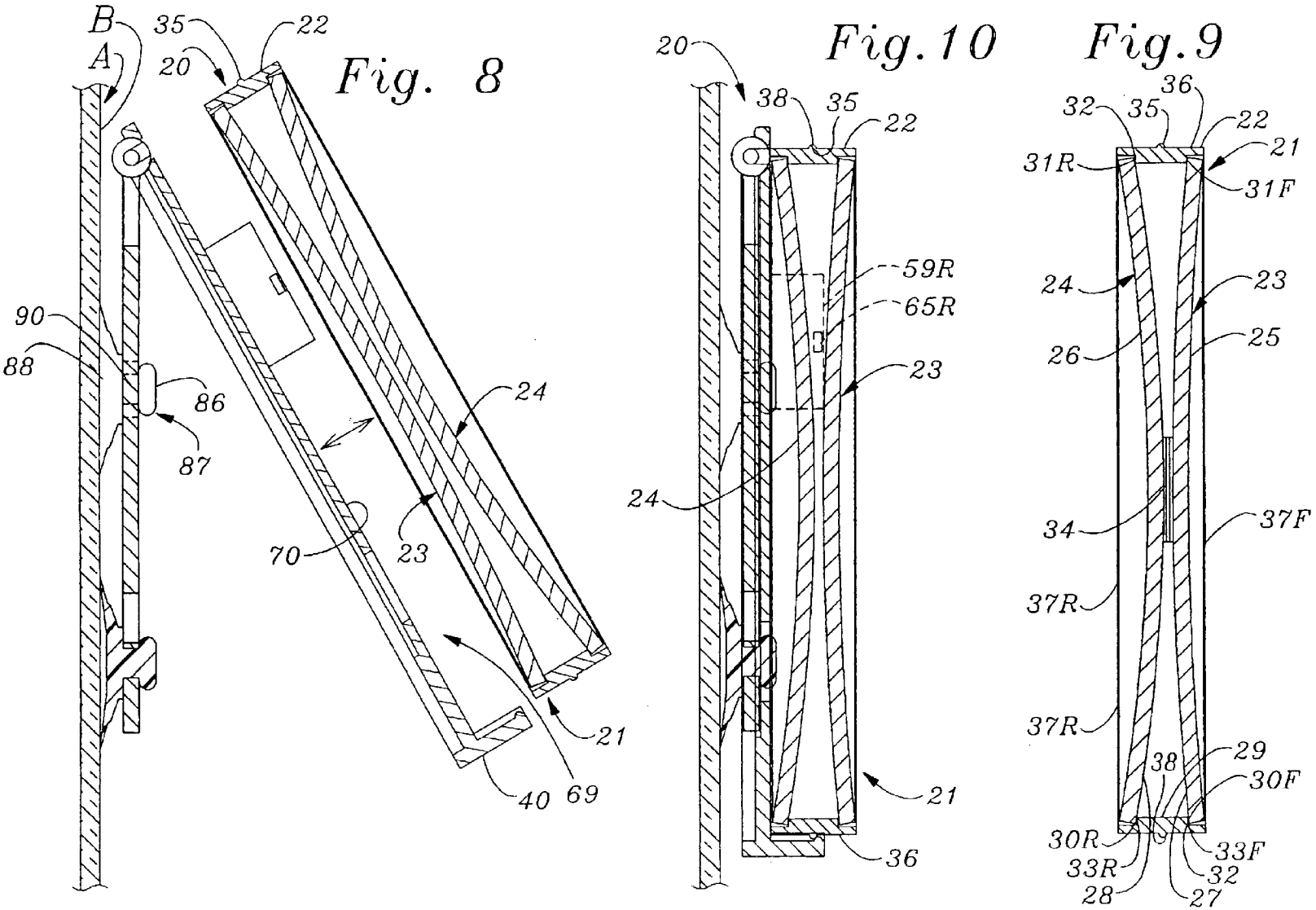
FIG. 8 is a vertical sectional view of the mirror of FIG. 1, showing the mirror frame holder and mirror frame thereof pivoted away from a mounting surface to an inclined viewing angle.
FIG. 9 is a vertical sectional view of a mirror frame which has been removed from the mirror frame holder of FIG. 8, and reversed.
FIG. 10 is a vertical sectional view of the mirror of FIG. 8, showing a dual mirror plate frame thereof having been removed from the mirror frame holder, rotated 180 degrees to reverse positions of two different magnification mirror plates thereof, and reinstalled in the mirror frame holder.

As shown in FIG. 9, mirror plates 23, 24 have convexly curved rear surfaces 27, 28. Also, mirror frame hoop 22 has formed in an inner cylindrical wall surface 29 thereof front and rear counterbore entrance openings 30F, 30R which form front and rear annular ring-shaped shoulder ledges 31F, 31R, respectively, that support the outer peripheral edges of rear surfaces 27, 28 of mirror plates 23, 24. Mirror plates 23, 24 are retained within mirror frame hoop 22 by conventional means, such as by a pressure-sensitive adhesive layer 32 between the transverse surfaces 33F, 33R of ledges 31F, 31R and the outer peripheral edges of rear mirror plate surfaces 27, 28. Preferably, mirror plates 23, 24 are also held in fixed relative relation and therefore fixed within hoop 22 by an additional adhesive layer 34 between central regions of rear surfaces 27, 28 of mirror plates 23, 24. As is also shown in FIG. 9, frame hoop 22 is provided with an annular ring-shaped rib 35 which protrudes radially outwardly from outer cylindrical surface 36 of the frame hoop. Hoop rib 35 is located equal distances from front and rear faces 37F, 37R of hoop 22, i.e., is longitudinally centrally located on the hoop. Rib 35 has a radiused, i.e., convex, arcuately curved outer surface 38.

Referring again to FIGS. 1–3B, it may be seen that mirror 20 according to the present invention includes a mirror frame holder 40 which releasably holds mirror frame assembly 21, and a mounting bracket 41 which is releasably attachable to a flat mounting surface and pivotably supports the mirror frame holder.

The structure and function of mirror frame holder 40 may be best understood by referring to FIGS. 2, 3A, 3B and 6–10. As shown in those figures, mirror frame holder 40 has a laterally symmetric plan-view shape which is similar to that of a cross having a relatively wide, vertically elongated central upright web section 42 which has protruding from opposite vertical sides thereof a pair of laterally opposed, upwardly angled left and right cross arms 43L, 43R. Frame holder 40 has a plate-like base portion 44 of generally uniform thickness, and has protruding rearwardly from rear surface 45 thereof a generally rectangular cross-section peripheral rib 46 which has a rear wall surface 47 spaced rearwardly of and parallel to rear base surface 45. Peripheral rib 46 arcuately joins outer wall surfaces of a lower end portion 48 of central vertical web section 42, and left and right cross arms 43L, 43R. Also, peripheral rib 46 has a pair of parallel, laterally spaced apart posts 49L, 49R adjacent to opposite sides 50L, 50R of an upper end portion of the central vertical web section 42 of frame holder base 44. A pair of coaxially aligned bushings 52L, 52R protrudes laterally inwardly from inner facing sides 53L, 53R of posts 49L, 49R. Bushings 52L, 52R have vertically disposed, laterally spaced apart inner facing vertical faces 54L, 54R which have extending outermost therefrom a pair of coaxially aligned, pivot pin bores 55L, 55R.

Figure 3A:
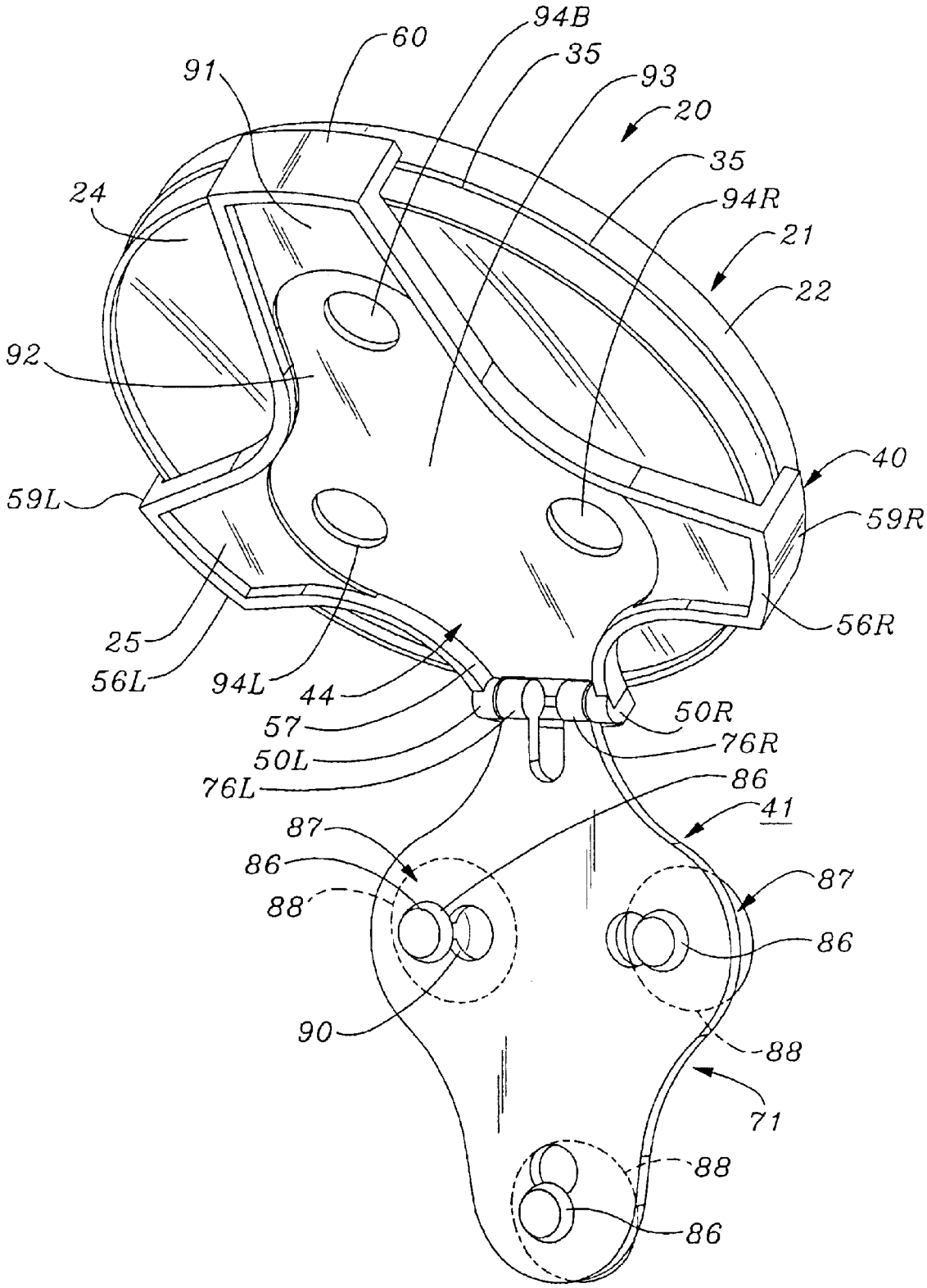
FIG. 3A is a front perspective view of the mirror of FIG. 1, showing a mounting bracket thereof pivoted away from a frame holder thereof.
Figure 3B:
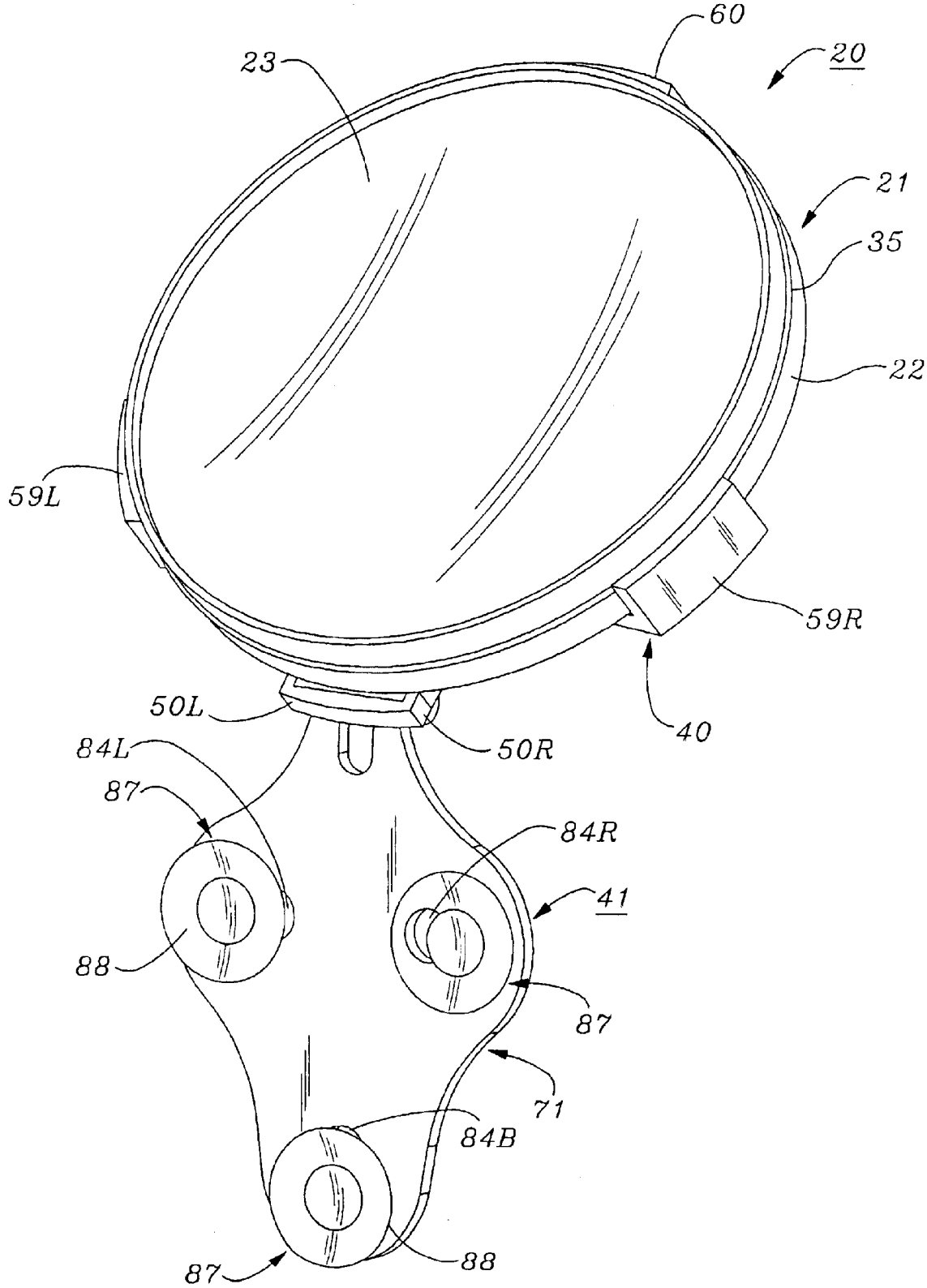
FIG. 3B is a rear perspective view of the mirror of FIG. 3A.
Figure 6:
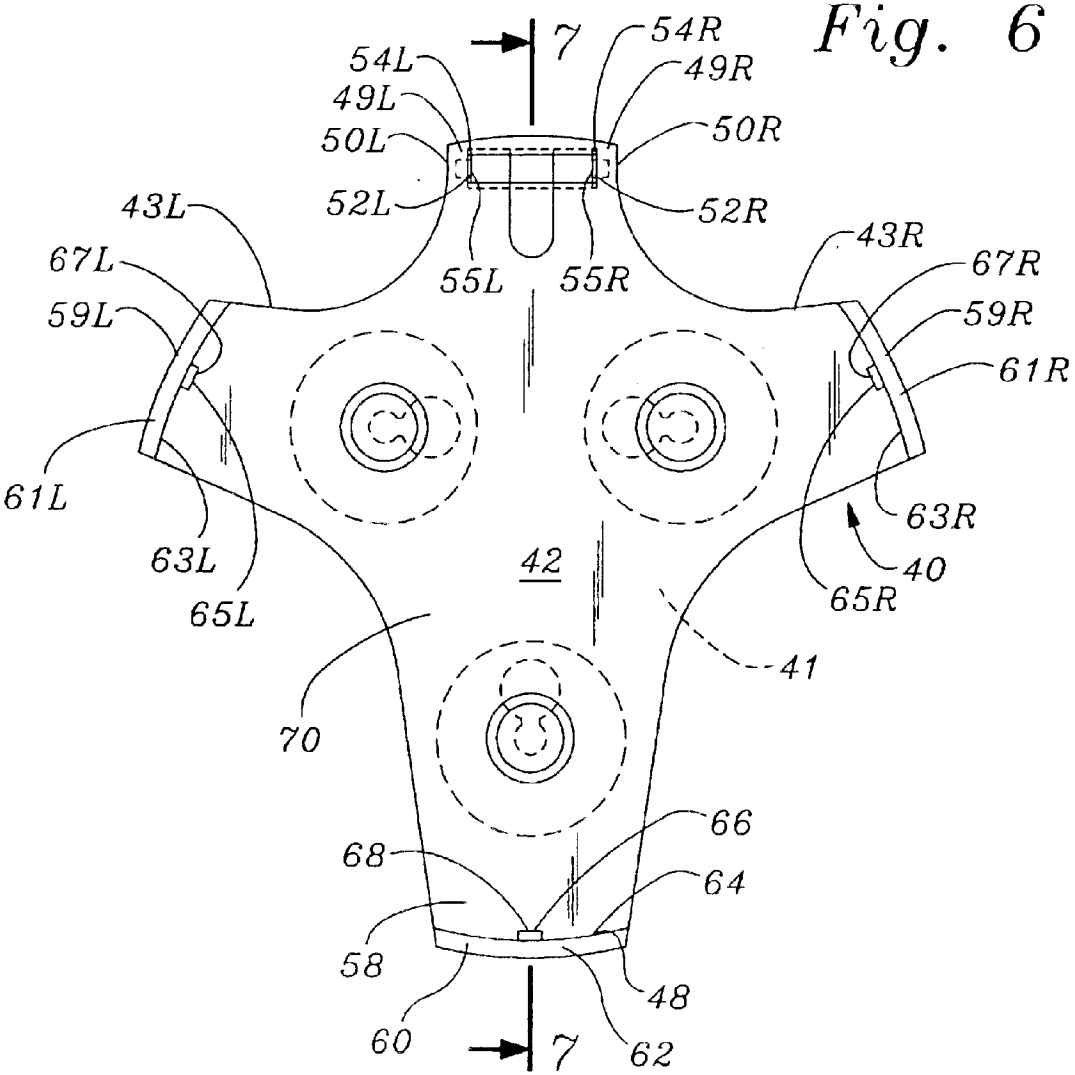
FIG. 6 is a front elevation view of a frame holder part of the mirror of FIG. 1.

As may be seen best by referring to FIGS. 3A, 3B, 6, and 7, the outer transverse ends 56L, 56R, and 57 of left and right cross arms and lower end portion 48 of frame holder base portion 44 have protruding perpendicularly upwardly or forwardly of front wall surface 58 of base web 42 flange walls 59L, 59R, and 60, respectively. As shown in FIGS. 3A, 3B and 6, flange walls 59L, 59 and 60 have a relatively uniform thickness, and have flat and co-planar upper wall surfaces 61L, 61R, and 62, respectively. Also, as may be seen best by referring to FIGS. 3 and 6, upper flange wall surfaces 61L, 61R and 62 are arcuately curved, and lie on a circle. As may be seen best by referring to FIG. 7, each flange wall 59L, 59R, and 60 has protruding radially inwardly of an inner longitudinally disposed side wall 63L, 63R, and 64 thereof an arcuately curved lip 65L, 65R, 66, respectively. Lips 65L, 65R and 66 have an arcuately curved transverse cross sectional shape, i.e., are radiused.

Frame holder 40 is so constructed that flange walls 59L, 59R and 60 are elastically deformable in a radial direction, i.e., perpendicular to a longitudinal center line of the mirror frame holder. Thus, in a preferred embodiment, mirror frame holder 40 is made of an elastically flexible polymer such as plastic. Also, spacing between the center of frame holder base 42 and the inner facing radiused surfaces 67L, 67R and 68 of flange wall lips 65L, 65R and 66 is slightly less than the radius of the outer cylindrical surface 36 of circumferential frame rib 35. With this construction, inserting mirror frame 21 into a cylindrically shaped receptacle opening 69 formed between flange wall lips 65L, 65R and 66 causes mirror frame rib 35 to slidably contact the lips and deform flange walls 59L, 59R and 60 elastically in radially outwardly directions. Pushing mirror frame 21 sufficiently far downwardly towards upper surface 70 of frame holder base 40 thus causes rear surface 71 of the frame to seat on the front surface of the frame holder, whereupon flange wall lips 65L, 65R, and 66 spring inwardly in front of the frame rib to thereby captivate the frame within the frame holder, as shown in FIGS. 8 and 9.

Figure 4:
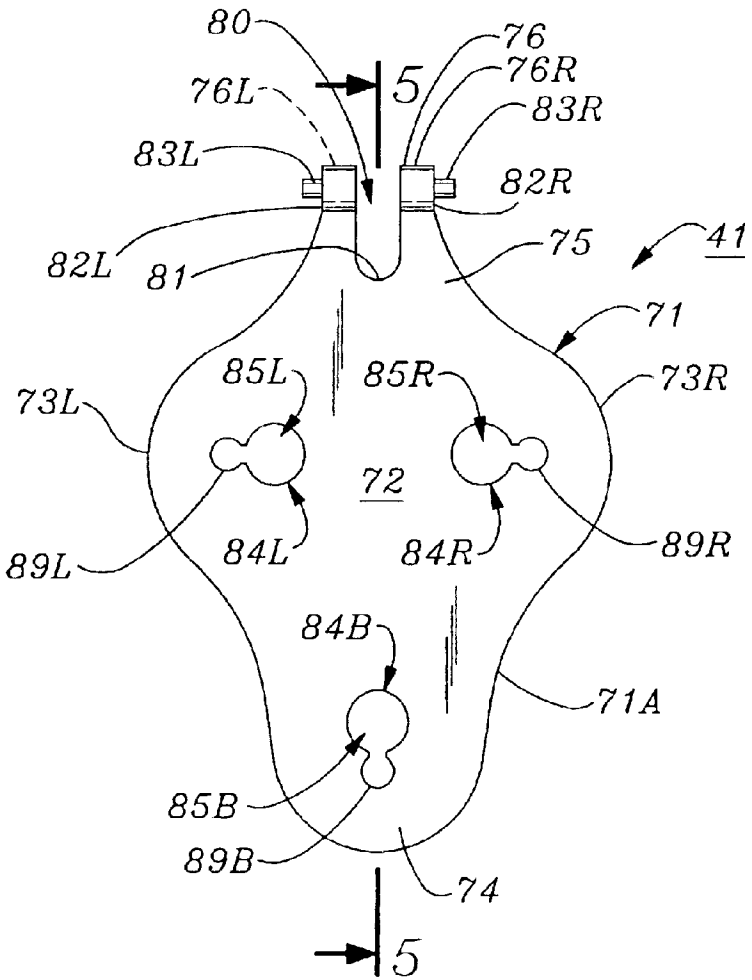
FIG. 4 is a fragmentary plan view of the mirror of FIG. 1, showing a mounting bracket thereof.

Referring now to FIGS. 2–5, it may be seen that mounting bracket 41 of mirror 20 includes a flat mounting bracket plate 71 of generally uniform thickness. As shown in FIG. 4, mounting bracket plate 71 has a laterally symmetric plan-view shape which approximates that of a cross which has a relatively wide, vertically elongated central upright web section 72 that has protruding from opposite vertical sides thereof a pair of laterally opposed left and right cross arm members 73L, 73R, respectively. Central upright web section 72 of mounting bracket plate 71 has a lower longitudinal end portion 74 and an upper longitudinal end portion 75. Although not necessary for the function of mounting bracket 41, the perimeter of mounting bracket plate may be a continuously and sinuously curved side wall 71A which joins the lower longitudinal end portion 74, left and right cross arms 73L, 73R, 11 and upper longitudinal end portion 75.

Figure 5:
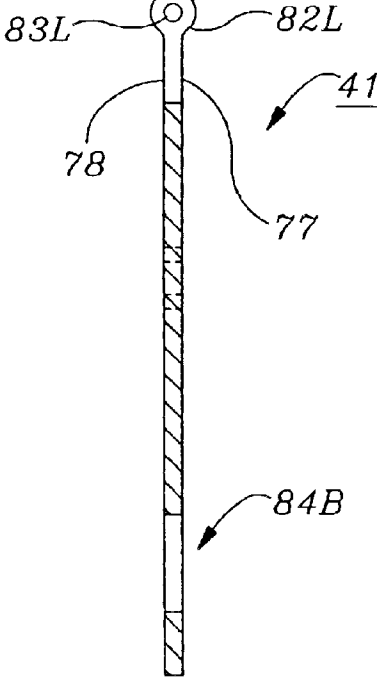
FIG. 5 is a vertical sectional view of the bracket of FIG. 4, taken in the direction of line 5—5.

As shown in FIGS. 4 and 5, upper longitudinal end portion 75 of mounting bracket plate 71 is terminated at an upper end thereof by a transversely disposed cylindrically-shaped enlargement 76 which has a diameter greater than the thickness of the mounting bracket plate and which arcuately and symmetrically joins front and rear wall surfaces 77, 78, respectively, of the mounting bracket plate. As shown in FIG. 4, cylindrically-shaped enlargement 76 has a transversely disposed upper edge wall in which is formed a rectangularly shaped, vertical slot 80. Slot 80, which preferably has an arcuately curved, concave lower end wall 81, bifurcates cylindrical enlargement 76 into left and right cylinders 76L, 76R, respectively. The latter have protruding laterally outwardly from opposite vertical faces 82L, 82R thereof coaxially aligned pivot pins 83L, 83R, respectively. As may be seen best by referring to FIGS. 1, 2, 7 and 8, pivot pins 83L, 83R fit in a relatively tight, but rotatably interference fit within pivot pin bores 55L, 55R of mirror frame holder bushings 52L, 52R, respectively.

Referring to FIG. 4, it may be seen that mounting bracket plate 71 has through its thickness dimension three keyhole-shaped suction cup mounting holes, including left and right holes 84L, 84R, and bottom hole 84B, located generally concentrically within outer portions of left and right cross arms 73L, 73R, and lower end portion 74 of central upright section 72, respectively, of the mounting bracket plate. Each keyhole 84L, 84R, 84B has a generally circularly shaped portion 85L, 85R, 85B of a diameter sufficiently large to receive the button-shaped head 86 of a suction cup 87 which has a concave, circular suction base 88. Also, each circularly-shaped portion 85L, 85R, 85B of keyholes 84L, 84R, 84B has disposed radially outwardly therefrom a generally oval shaped slot 89L, 89R, 89B, respectively. Each of the slots has a width smaller than the diameter of a suction cup head 86, but of sufficient width to enable the neck 90 of the suction cup to slide within the slot. This construction facilitates installation of suction cups 87 in mounting bracket plate 71, and disengaging the mounting bracket plate from suction cups. This is accomplished by positioning the head 86 of suction cup in vertical alignment with a larger diameter portion 85 of a keyhole 84 and sliding the neck 90 of the suction cup in slot 89 to captivate the lower surface of the suction cup head within the slot, when it is desired to engage the suction cups with the mounting bracket plate, and reversing the aforementioned steps to unfasten the bracket plate from the suction cups.

Figure 7:
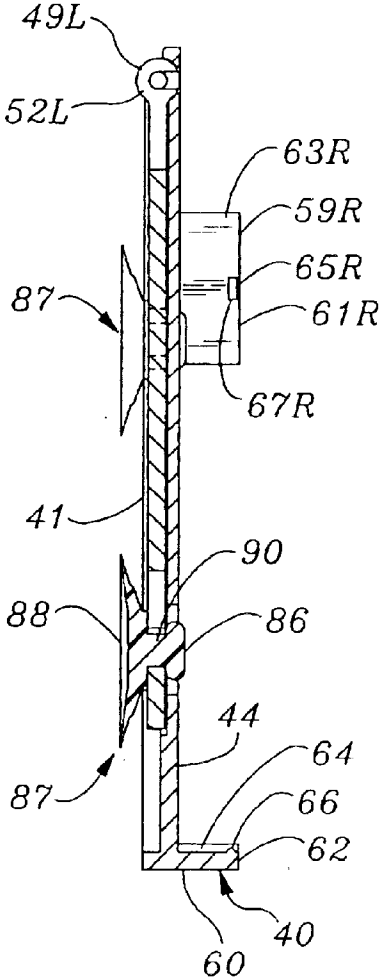
FIG. 7 is a vertical sectional view of the frame holder of FIG. 7 taken in the direction of line 7—7.

As shown in FIG. 3A, lower wall surface 91 of mirror frame holder base 44 preferably has formed therein a shallow uniform depth recess 92 which has the same outline shape but of slightly larger size than the plan-view shape of mounting bracket plate 71. Also, recess 92 preferably has formed through base wall 93 thereof three circular perforations 94L, 94R, 94B, which have the same relative orientation with respect to the perimeter of recess 92 as that of keyholes 84L, 84R, and 84B to the perimeter of mounting bracket plate 71. With this arrangement, mirror frame holder 41 is pivotable into a flush, parallel overlying relationship to mounting base 40, with mounting base bracket 71 received in recess 92 in the rear of the mirror holder frame, and suction cup heads 86L, 86R, 86B received in perforations 94L, 94R, 94B, through base 44 of the mirror holder frame, as shown in FIGS. 2, 7 and 10.

Figure 1:
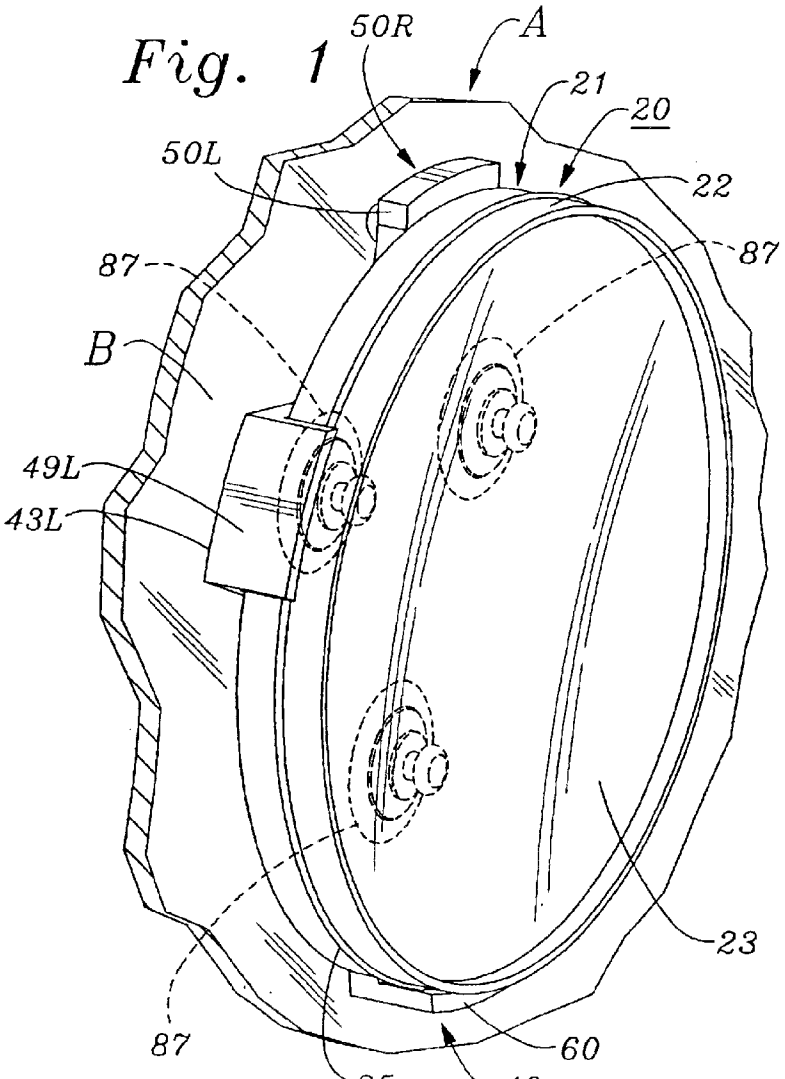
FIG. 1 is a perspective view of a dual magnification reversible spot mirror releasably attachable to a flat mirror according to the present invention.

The manner of using dual magnification reversible spot mirror device 20 according to the present invention may be best understood by referring to FIGS. 1 and 8–10. As shown in FIG. 1, mirror 20 is readily attached to a relatively smooth, flat vertical or horizontal mounting surface such as the front surface B of a wall or cabinet mounted mirror A by pressing the mirror holder frame downward towards the mounting surface, thereby hermetically adhering suction cups 87 which protrude rearwardly from the frame holder mounting bracket plate to the mounting surface. Mirror device 20 may be attached to a mounting surface with the mirror frame assembly 21 installed in mirror frame holder 40 and oriented parallel thereto, as shown in FIG. 1. Optionally, frame assembly 21 may be pivoted upwardly away from mirror frame holder 40, as shown in FIGS. 3A, 3B and 8, and/or may be optionally removed from the mirror frame holder, as shown in FIG. 8. Those configurations of mirror frame assembly 21 are preferably employed to unfasten suction cups 87 from a mounting surface, since, as explained above, this facilitates sliding necks 90 of the suction cups in oval slots 84 through mounting bracket plate 71, to thereby align heads 86 of the suction cups with larger diameter portions 85 of mounting bracket plate keyholes 84, whereupon the mounting bracket plate can be pulled forward from the mounting surface, the suction cup heads being pulled through those circular portions of the keyholes.

As shown in FIG. 8, mirror frame assembly 21 may be removed from mirror frame holder 40 in which it is installed with a particular magnification mirror plate, e.g., 10× magnification mirror plate 24, facing forward for viewing by a user, reversed to position the other mirror plate, e.g., lower, 5× magnification plate 23 forward, and re-installed in the mirror frame holder as shown in FIG. 10.

What is claimed is:

1. A mirror device for providing reflected images having at least two different selectable magnifications, said mirror device comprising:

a. at least a first mirror frame retaining therein a pair of first and second mirrors having reflective surfaces of first and second, different magnifications, said mirrors being arranged back-to-back with said reflecting surfaces facing outwards of one another, b. a frame holder, c. holding means for releasably and interchangeably holding said mirror frame in said frame holder with a selected one of said mirrors facing away from said frame holder for viewing images of objects in front of said selected mirror, said holding means comprising in combination, i. a peripheral mirror frame ring which at least partially bounds outer peripheral edges of said first and second mirrors, ii. at least two radially spaced apart frame holder flange walls which protrude forward from a base portion of said frame holder, and iii. releasable engagement means for fixedly and releasably holding said peripheral frame ring fixed with respect to said flange walls, said releasable engagement means comprising in combination at least a first rib member which protrudes radially outwardly from said peripheral frame ring, a retainer lip which protrudes inwardly from an inner axially disposed surface of each of said frame holder flange walls, said lips having inner, longitudinally disposed surfaces which define therebetween an opening having a spacing less than that between longitudinal outer surfaces of opposed portions of said mirror frame rib longitudinally alignable with said flange walls, and means for engaging said flange walls to deflect radially outwardly sufficiently far for said opening therebetween to receive said mirror frame rib, and for deflecting said flange walls radially inwardly in front of said rib to thereby retain said peripheral frame ring in a pocket formed between an outer transverse surface of said frame holder base and rear surfaces of said lips, d. a mounting base for supporting said frame holder, and e. fastener means for releasably attaching said mounting base to a mounting surface.

2. The mirror device of claim 1 wherein said means for enabling deflection of said flange walls radially outwardly and inwardly is further defined as including resilient coupling means between said base of said frame holder and said flange walls, whereby pressing said rib of said peripheral ring of said frame member against radiused front surfaces of said flange wall lips causes said flange walls to deflect radially and resiliently outwards.

3. The mirror device of claim 2 wherein said resilient coupling means comprises an elastically deformable polymer joint between each of said flange walls and said base of said frame holder.

4. The mirror device of claim 1 further including angularly adjustable coupling means joining said frame holder to said mounting base, said adjustable coupling means enabling said frame to be fixedly positioned at an adjustable angle relative to said mounting base.

5. The mirror device of claim 4 wherein said angularly adjustable coupling means joining said frame holder to said mounting base comprises in combination;

a. at least a first pivot pin fastened to one of said mounting base and said mirror holder frame, and b. at least a first bushing fastened to the other end of said mounting base and said frame holder, said bushing rotatably and fictionally receiving said pivot pin.

6. The mirror device of claim 1 wherein said fastening means for releasably attaching said mounting base to a mounting surface comprises at least a first suction cup which protrudes rearwardly from a rear surface of said mounting base.

7. The mirror device of claim 6 further including releasable securing means for releasably attaching said suction cup to said mounting base.

8. The mirror device of claim 7 wherein said releasable securing means is further defined as comprising in combination;

a. a neck protruding from a concave base of said suction cup, said neck terminating at an upper end thereof in a concentric button-shaped head of smaller diameter than said base, and b. at least a first keyhole through a thickness dimension of said mounting base, said keyhole having a circularly-shaped portion of larger diameter than said head of said suction cup, and a slot disposed radially outwardly from said circularly-shaped portion of said keyhole, said slot having a width sufficiently large to enable slidable movement of said suction cup neck therewithin, and sufficiently small to prevent said head of said suction cup from being pulled through said slot in a direction perpendicular to said mounting base.

9. A mirror device having at least two selectable magnifications, said mirror device comprising:

a. at least a first mirror frame including a peripheral cylindrical ring retaining therein a pair of back-to-back mirrors, at least one of which has a concave, spherically-shaped surface which has a curvature and therefore magnification different than that of the other of said pair of mirrors, b. a mirror frame holder having a generally flat base portion and protruding forward from said base portion a plurality of flange walls forming between inner longitudinally disposed wall surfaces thereof a cylindrically-shaped pocket adapted to longitudinally receive said cylindrical ring of said mirror frame ring, c. means for releasably securing said mirror frame within said pocket of said mirror frame holder, said means comprising in combination, i. at least a first peripheral rib which protrudes radially outwardly from an outer cylindrical wall surface of said peripheral mirror frame ring, ii. engagement means attached to said flange walls for releasably engaging said peripheral frame ring rib, said engagement means comprising in combination, iii. at least one pair of lips, each of which protrudes radially inwardly from an inner longitudinal wall surface of each of at least two opposed flange walls, said lips forming between opposed inner facing inner longitudinal wall surfaces thereof a space of less diameter than that of corresponding parts of said peripheral frame ring rib, and iv. resilient coupling means joining said flange walls to said base of said mirror frame holder, said resilient coupling means enabling said flange walls to be deflected elastically outwards in a radial direction when said peripheral frame ring rib is pressed downwards against said lips towards said base of said frame holder, and to elastically deflect to an unstressed position with said lips positioned axially in front of said peripheral frame ring rib, thereby retaining said mirror frame within said pocket of said mirror frame holder, d. a mounting base having generally flat and parallel upper and lower surfaces, e. support means for supporting said mirror frame holder from said mounting base, and f. releasable fastening means for releasably attaching said mounting base to a mounting surface.

10. The mirror device of claim 9 wherein said support means for supporting said mirror frame holder from said mounting base is further defined as being a pivot joint.

11. The mirror device of claim 9 wherein said releasable fastening means for releasably attaching said mounting base to a mounting surface is further defined as being a plurality of suction cups which protrude rearwardly from a rear surface of said mounting base.

12. The mirror device of claim 11 further including releasable attachment means for attaching said suction cups to said mounting base.

13. The mirror device of claim 12 wherein said releasable attachment means is further defined as comprising in combination;

a. a neck protruding from a concave base of said suction cup, said neck terminating at an upper end thereof in a concentric button-shaped head of smaller diameter than said base, and b. at least a first keyhole through a thickness dimension of said mounting base, said keyhole having a circularly-shaped portion of larger diameter than said head of said suction cup, and a slot disposed radially outwardly from said circularly-shaped portion of said keyhole, said slot having a width sufficiently large to enable slidable movement of said suction cup neck therewithin, and sufficiently small to prevent said head of said suction cup from being pulled through said slot in a direction perpendicular to said mounting base.

14. A mirror device having at least two selectable magnifications, said mirror device comprising:

a. at least a first mirror frame including a peripheral cylindrical ring holding therein a pair of back-to-back mirrors, at least one of which has a concave, spherically-shaped surface which has a curvature and therefore magnification different than that of the other of said pair of mirrors, b. a mirror frame holder having a generally flat base portion and protruding forward from said base portion a plurality of flange walls forming between inner longitudinally disposed wall surfaces thereof a cylindrically-shaped pocket adapted to longitudinally receive said cylindrical ring of said mirror frame, c. means for releasably securing said mirror frame within said pocket of said mirror frame holder, d. a mounting base having generally flat and parallel upper and lower surfaces, e. support means for supporting said mirror frame holder from said mounting base, and f. releasable fastening means comprising a plurality of suction cups which protrude rearwardly from a rear surface of said mounting base for releasably attaching said mounting base to a mounting surface.

* * * * *